US010954756B2

(12) United States Patent
da Silva et al.

(10) Patent No.: US 10,954,756 B2
(45) Date of Patent: Mar. 23, 2021

(54) CORE BIT DESIGNED TO CONTROL AND REDUCE THE CUTTING FORCES ACTING ON A CORE OF ROCK

(71) Applicant: Halliburton Energy Services, Inc., Houston, TX (US)

(72) Inventors: Nuno da Silva, Brussels (BE); Ludovic Delmar, Braine l'alleud (BE); Didier Rousseau, Ophain (BE); Stephan Regnard, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 684 days.

(21) Appl. No.: 15/529,826

(22) PCT Filed: Dec. 29, 2014

(86) PCT No.: PCT/US2014/072499
§ 371 (c)(1),
(2) Date: May 25, 2017

(87) PCT Pub. No.: WO2016/108812
PCT Pub. Date: Jul. 7, 2016

(65) Prior Publication Data

US 2017/0328180 A1 Nov. 16, 2017

(51) Int. Cl.
*E21B 41/00* (2006.01)
*E21B 10/48* (2006.01)
(Continued)

(52) U.S. Cl.
CPC ..... *E21B 41/0092* (2013.01); *E21B 10/02* (2013.01); *E21B 10/48* (2013.01); *E21B 10/485* (2013.01); *E21B 49/00* (2013.01)

(58) Field of Classification Search
CPC ..... E21B 41/0092; E21B 10/02; E21B 10/48; E21B 10/485; E21B 49/00
(Continued)

(56) References Cited

U.S. PATENT DOCUMENTS 5,131,478 A * 7/1992 Brett ..... E21B 10/43 175/57
5,568,838 A 10/1996 Struthers et al.
(Continued)

FOREIGN PATENT DOCUMENTS

CN 1058824 2/1992
EP 0467580 10/1994

OTHER PUBLICATIONS

Benjamin_1994 (Diamond Drilling for Core Sampling, Longyear Austrailia pp. 82-96, 1994 (Year: 1994).*
(Continued)

*Primary Examiner* — Brian S Cook
(74) *Attorney, Agent, or Firm* — Thomas Rooney; Baker Botts L.L.P.

(57) ABSTRACT

A method for designing a core bit to control and reduce the cutting forces acting on a core of rock is disclosed. The method includes generating a model of a core bit including a plurality of cutting elements on a plurality of blades. The method may additionally include simulating a coring operation with the model of the core bit. The method may further include calculating at least one force vector generated by at least one of the plurality of cutting elements on the model of the core bit during the coring operation. The method may further include determining at least one force acting on a core in the model of the core bit based on the at least one force vector and generating a design of the core bit based on the at least one force acting on the core.

19 Claims, 8 Drawing Sheets

(51) Int. Cl.
*E21B 10/02* (2006.01)
*E21B 49/00* (2006.01)

(58) Field of Classification Search
USPC ..... 703/1
See application file for complete search history.

(56) References Cited

U.S. PATENT DOCUMENTS

| | | | | |
|---|---|---|---|---|
| 7,457,734 | B2 | 11/2008 | Johnson et al. | |
| 2003/0173116 | A1 | 9/2003 | Wells et al. | |
| 2011/0226533 | A1 | 9/2011 | Adams | |
| 2011/0240376 | A1* | 10/2011 | Chen | E21B 10/55 175/336 |
| 2011/0259649 | A1 | 10/2011 | Matthews et al. | |
| 2012/0118642 | A1 | 5/2012 | Vempati et al. | |
| 2012/0152623 | A1 | 6/2012 | Chen | |
| 2012/0152624 | A1* | 6/2012 | Chen | G06F 30/17 175/428 |

OTHER PUBLICATIONS

Office Action for Chinese Patent Application No. 201480083266.5, dated May 27, 2019; 11 pages.
Office Action for Chinese Patent Application No. 201480083266.5, dated Sep. 11, 2018; 15 pages.
G.M. Clydesdale et al., "Low Invasion Corehead Reduces Mud Invasion While Improving Performances", ASME vol. 116, pp. 258-267 ; 10 pages, Dec. 1994.
International Search Report and Written Opinion for PCT Patent Application No. PCT/US2014/072499, dated Sep. 9, 2015; 13 pages.
Office Action for Canadian Patent Application No. 2966845 dated Feb. 22, 2018; 4 pages.

* cited by examiner

CORE BIT DESIGNED TO CONTROL AND REDUCE THE CUTTING FORCES ACTING ON A CORE OF ROCK

RELATED APPLICATIONS

This application is a U.S. National Stage Application of International Application No. PCT/US2014/072499 filed Dec. 29, 2014, which designates the United States, and which is incorporated herein by reference in its entirety.

TECHNICAL FIELD

The present disclosure relates generally to drilling tools and, more particularly, to a core bit designed to control and reduce the cutting and friction forces acting on a core of rock.

BACKGROUND

Various types of drilling tools including, but not limited to, rotary drill bits, reamers, core bits, under reamers, hole openers, stabilizers, and other downhole tools have been used to form boreholes in associated downhole formations. Examples of such rotary drill or core bits include, but are not limited to, fixed cutter drill or core bits, drag bits, polycrystalline diamond compact (PDC), thermo-stable diamond (TSD), natural diamond, or diamond impregnated drill or core bits, and matrix or steel body drill or core bits associated with forming oil and gas wells extending through one or more downhole formations. Fixed cutter drill bits or core bits such as a PDC drill bit or core bit may include multiple blades that each include multiple cutting elements.

Hydrocarbons, such as oil and gas, often reside in various forms within subterranean geological formations. Often, a core bit is used to obtain representative samples of rock taken from a formation of interest. These rock samples are generally referred to as "core samples." Analysis and study of core samples enable engineers and geologists to assess formation parameters such as the reservoir storage capacity, the flow potential of the rock that makes up the formation, the composition of the recoverable hydrocarbons or minerals that reside in the formation, and the irreducible water saturation level of the rock. For instance, information about the amount of fluid may be useful in the subsequent design and implementation of a well completion program that enables production of selected formations and zones that are determined to be economically attractive based on the data obtained from the core sample.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

A core bit may be designed to minimize the forces exerted on the core sample and/or the areas of the formation from which the core sample will be cut (collectively "the core") by one or more cutting elements on the core bit. A core bit designed to minimize the forces exerted on the core may minimize wear and/or fracturing of the core. Additionally, the core bit may reduce the occurrence of jamming during the coring operation, where no additional length of core may enter the coring tube. Accordingly, tools and methods may be designed in accordance with the teachings of the present disclosure and may have different designs, configurations, and/or parameters according to the particular application. Embodiments of the present disclosure and its advantages are best understood by referring to FIGS. 1 through 8, where like numbers are used to indicate like and corresponding parts.

Figure 1:
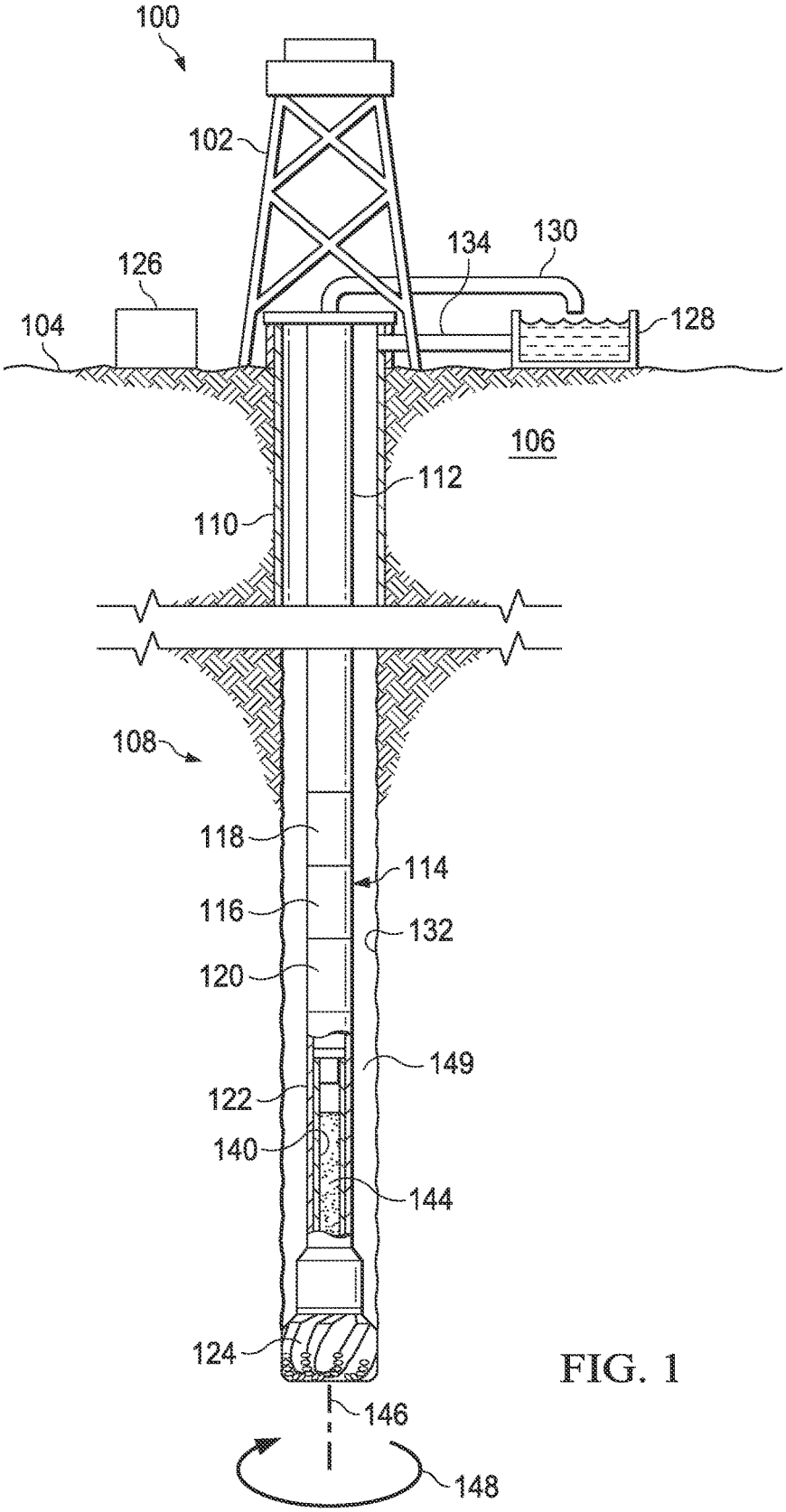
FIG. 1 is an elevation view of an example embodiment of a coring system.

FIG. 1 is an elevation view of an example embodiment of a drilling system. Drilling system 100 may include a surface or site 104 located above geological formation 106. Various types of drilling equipment such as a rotary table, drilling fluid pumps, and drilling fluid tanks (not expressly shown) may be located at surface 104. For example, surface 104 may include drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles, and drilling barges (not expressly shown).

Drilling system 100 may also include drill string 112 associated with core bit 124 that may be used to form a wide variety of boreholes such as borehole 132. Drilling rig 102 may be coupled to drilling assembly 108 within borehole 132 in formation 106. Drilling assembly 108 may include drill string 112 and bottom hole assembly (BHA) 114. Drill string 112 may include a plurality of tubular segments coupled in series to define an inner bore through which drilling fluid may be pumped, as will be described below. Borehole 110 may be partially covered by steel casing 110.

BHA 114 may be formed from a wide variety of components configured to form a borehole 132. For example, components of BHA 114 may include, but are not limited to, core bits (e.g., core bit 124), drill collars, downhole drilling or coring motors, drilling or coring parameter sensors for weight, torque, rotational speed, tilt angle, and direction measurements of drill string 112 and other acceleration related sensors, stabilizers, measurement while drilling (MWD) components containing borehole survey equipment, logging while drilling (LWD) sensors for measuring formation parameters, short-hop and long haul telemetry systems used for communication, and/or any other suitable downhole equipment. The number of components such as drill collars and different types of components included in BHA 114 may depend upon anticipated downhole coring conditions and the type of borehole that will be formed by drill string 112 and core bit 124. BHA 114 may also include various types of borehole logging tools (not expressly shown). Examples of such logging tools may include, but are not limited to, acoustic, neutron, gamma ray, density, porosity, sonic, photoelectric, nuclear magnetic resonance, and/or any other commercially available logging tool.

BHA 114 may also include telemetry system 116, recording module 118, downhole controller 120, coring assembly barrel 122, and core bit 124. Coring assembly barrel 122 may include an inner barrel tube 140 to receive core 144. Telemetry system 116 may communicate with surface control unit 126 via mud pulses, wired communications, or wireless communications. Surface control unit 126 may include, for example, a microprocessor or controller coupled to a memory device that contains a set of instructions. The set of instructions, when executed by the processor, may cause the processor to perform certain actions such as sending commands to BHA 114 to control the operation of BHA 114. Surface control unit 126 may transmit commands to elements of BHA 114 using mud pulses or other communication media that are received by telemetry system 116. Likewise, telemetry system 116 may transmit information to surface control unit 126 from elements in BHA 114. For example, measurements of formation 106 and borehole 132 taken within BHA 114 may be transmitted to surface control unit 126 through telemetry system 116. Measurements transmitted to surface control unit 126 may include the temperature and pressure in borehole 132.

Like surface control unit 126, downhole controller 120 may include a microprocessor or a controller coupled to a memory device including instructions stored therein. Downhole controller 120 may issue commands to elements within BHA 114 in response to commands from surface control unit 126, or downhole controller 120 may issue the commands without being prompted by surface control unit 126.

During coring operations, drilling fluid may be pumped into drill string 112 from surface reservoir 128 through pipe 130. The drilling fluid may flow through drill string 112 and exit from core bit 124, lubricating and cooling the cutting face of core bit 124 and carrying cuttings from core bit 124 to surface 104. The drilling fluid may return to surface 104 through wellbore annulus 149 between BHA 114 and drilling string 112 and the wall of borehole 132. The drilling fluid may return to surface reservoir 128 through flow pipe 134 in fluid communication within annulus 149.

Figure 2:
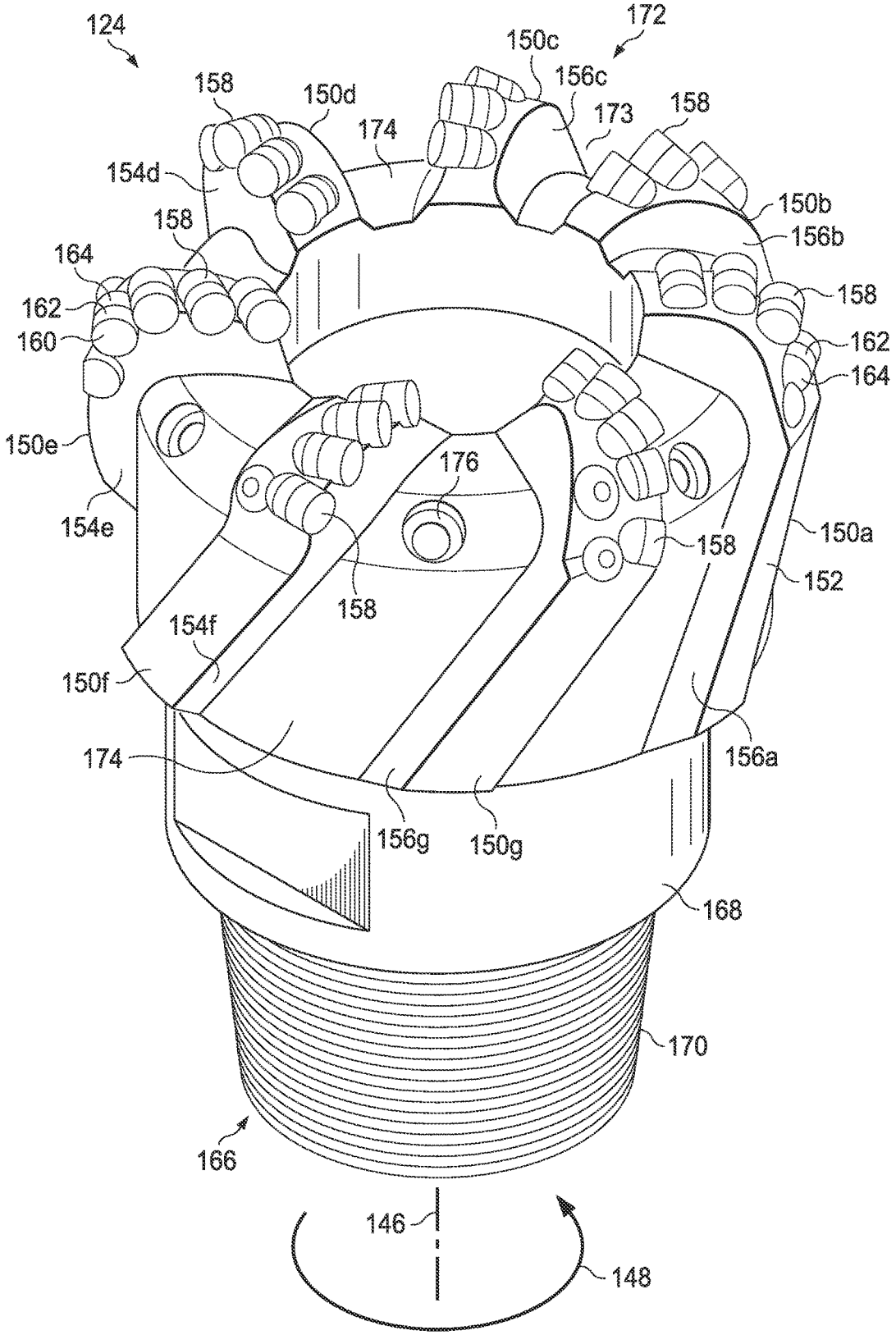
FIG. 2 illustrates an isometric view of a rotary core bit oriented upwardly in a manner often used to model or design fixed cutter bits and core bits.

Core bit 124 may be a coring drill bit that has a central opening, as discussed in further detail in FIG. 2, and may include one or more blades that may be disposed outwardly from exterior portions of a bit body of core bit 124. The bit body may be generally curved and the one or more blades may be any suitable type of projections extending outwardly from the bit body. Core bit 124 may rotate with respect to bit rotational axis 146 in a direction defined by directional arrow 148. The blades may include one or more cutting elements disposed outwardly from exterior portions of each blade. The blades may further include one or more gauge pads (not expressly shown). Core bit 124 may be designed and formed in accordance with teachings of the present disclosure and may have many different designs, configurations, and/or dimensions according to the particular application of core bit 124.

As core bit 124 rotates and cuts into formation 106, it may form a generally cylindrical core sample 144 by cutting formation 106 around the central opening of core bit 124. Formation 106 may remain intact in the central opening and core sample 144 may be formed from the intact formation located in the central opening. According to aspects of the present disclosure, core sample 144 may be captured in inner barrel 140. Coring assembly barrel 122 may be coupled to other elements within BHA 114, such as telemetry system 116 or downhole controller 120. In other embodiments, coring assembly barrel 122 may be coupled to drill string 112. Inner barrel 140 may be stationary while coring assembly barrel 122 may rotate with drill string 112. In certain embodiments, core sample 144 may be retrieved from inner barrel 140 at surface 104 to perform tests that cannot be performed downhole.

In the process of cutting core sample 144 from formation 106, core sample 144 and/or portions of formation 106 that may become part of core sample 144 (hereinafter "the future core") may be subject to various stresses that may damage core sample 144 and/or the future core. For example, as core bit 124 cuts into formation 106, a portion of the cutting forces exerted by the cutting elements located on the blades of core bit 124 may be directed toward the zones of formation 106 from which core sample 144 is or will be cut. The forces exerted on core sample 144 and/or the future core may wear and/or weaken core sample 144 and/or the future and may fracture it. Therefore, core bit 124 may be modeled to predict the effect of forces generated by core bit 124 on core sample 144 and/or the future core during a coring operation to allow for designing core bit 124 such that the forces acting on core sample 144 and/or the future core may be reduced. The use of a core bit designed in accordance with the present disclosure may prevent core sample 144 and/or the future core from breaking or wearing during the coring operation. In one embodiment, an interaction model may be used to predict the forces created by core bit 124 and the interaction of those forces with core sample 144 and/or the future core.

FIG. 2 illustrates an isometric view of a rotary core bit oriented upwardly in a manner often used to model or design fixed cutter bits and core bits. Core bit 124 may be any type of fixed cutter core bits, including PDC core bits, thermally stable polycrystalline (TSP) core bits, diamond impregnated core bits, and/or cutting structure combinations core bits including cutting elements configured to form borehole 132 (as illustrated in FIG. 1) extending through one or more subterranean formations 106. Core bit 124 may be designed and formed in accordance with teachings of the present disclosure and may have many different designs, configurations, and/or dimensions according to the particular application of core bit 124.

Core bit 124 may include one or more blades 150*a*-150*g* ("blades 150") that may be disposed outwardly from exterior portions of bit body 174. Bit body 174 may be generally curved and blades 150 may be any suitable type of projections extending outwardly from bit body 174. For example, a portion of blade 150 may be directly or indirectly coupled to an exterior portion of bit body 174, while another portion of blade 150 may be projected away from the exterior portion of bit body 174. Blades 150 formed in accordance with teachings of the present disclosure may have a wide variety of configurations including, but not limited to, substantially straight, arched, helical, spiraling, tapered, converging, diverging, symmetrical, and/or asymmetrical.

Each of blades 150 may include a first end disposed toward bit rotational axis 146 and a second end disposed proximate or toward exterior portions of core bit 124 (e.g., disposed generally away from bit rotational axis 146 and toward uphole portions of core bit 124). The terms "downhole" and "uphole" may be used in this application to describe the location of various components of drilling system 100 relative to the bottom or end of a borehole. For example, a first component described as "uphole" from a second component may be further away from the distal end of borehole 132 than the second component. Similarly, a first component described as being "downhole" from a second component may be located closer to the distal end of borehole 132 than the second component.

In some cases, blades 150 may have substantially arched configurations, generally helical configurations, spiral shaped configurations, or any other configuration satisfactory for use with core bit 124. One or more blades 150 may have a substantially arched configuration extending from proximate rotational axis 146 of core bit 124. The arched configuration may be defined in part by a generally concave, recessed shaped portion extending from proximate bit rotational axis 146. The arched configuration may also be defined in part by a generally convex, outwardly curved portion disposed between the concave, recessed portion and exterior portions of each blade which correspond generally with the outside diameter of core bit 124.

Blades 150 may have a general arcuate configuration extending radially from rotational axis 146. The arcuate configurations of blades 150 may cooperate with each other to define, in part, a generally cone shaped or recessed portion disposed adjacent to and extending radially outward from the bit rotational axis. Exterior portions of blades 150, cutting elements 158 and other suitable elements may be described as forming portions of the core bit face.

The number and location of blades 150 may vary such that core bit 124 includes more or less blades 150. Blades 150 may be disposed symmetrically or asymmetrically with regard to each other and bit rotational axis 146 where the disposition may be based on the downhole conditions of the coring environment. In some cases, blades 150 and bit body 174 may rotate about rotational axis 146 in a direction defined by directional arrow 148.

Each blade may have a leading (or front) surface 154 disposed on one side of the blade in the direction of rotation of bit body 174 and a trailing (or back) surface 156 disposed on an opposite side of the blade away from the direction of rotation of core bit 124. Blades 150 may be positioned along bit body 174 such that they have a spiral configuration relative to rotational axis 146. In other embodiments, blades 150 may be positioned along bit body 174 in a generally parallel configuration with respect to each other and bit rotational axis 146.

Blades 150 may include one or more cutting elements 158 disposed outwardly from exterior portions of each blade 150. For example, a portion of cutting element 158 may be directly or indirectly coupled to an exterior portion of blade 150 while another portion of cutting element 158 may be projected away from the exterior portion of blade 150. Cutting elements 158 may be any suitable device configured to cut into a formation, including but not limited to, primary cutting elements, back-up cutting elements, secondary cutting elements, or any combination thereof. By way of example and not limitation, cutting elements 158 may be various types of cutters, compacts, buttons, inserts, and gage cutters satisfactory for use with a wide variety of core bits 124.

Cutting elements 158 may include respective substrates 162 with a layer of hard cutting material, e.g., cutting table 160, disposed on one end of each respective substrate 162. Cutting table 160 of each cutting element 158 may provide a cutting surface that may engage adjacent portions of formation 106 to form borehole 132. Each substrate 162 of cutting elements 158 may have various configurations and may be formed from tungsten carbide with a binder agent such as cobalt or other materials associated with forming cutting elements for rotary core bits. Tungsten carbides may include, but are not limited to, monotungsten carbide (WC), ditungsten carbide ($W_2C$), macrocrystalline tungsten carbide, and cemented or sintered tungsten carbide. Substrates 162 may also be formed using other hard materials, which may include various metal alloys and cements such as metal borides, metal carbides, metal oxides, and metal nitrides. For some applications, cutting table 160 may be formed from substantially the same materials as substrate 162. In other applications, cutting table 160 may be formed from different materials than substrate 162. Examples of materials used to form cutting table 160 may include polycrystalline diamond materials, including synthetic polycrystalline diamonds. Blades 150 may include recesses or bit pockets 164 that may be configured to receive cutting elements 158.

Blades 150 may further include one or more gauge pads 152. A gage pad may be a cylindrical area disposed on an exterior portion of blade 150. Gauge pads may often contact adjacent portions of borehole 132 formed by core bit 124. Exterior portions of blades 150 and/or associated gauge pads may be disposed at various angles, positive, negative, and/or parallel, relative to adjacent portions of generally vertical portions of borehole 132. A gauge pad may include reinforcing elements and/or one or more layers of hardfacing material.

Uphole end 166 of core bit 124 may include shank 168 with threads 170 formed thereon. Threads 170 may be used to releasably engage core bit 124 with BHA 114, shown in FIG. 1, whereby core bit 124 may be rotated relative to bit rotational axis 146. Downhole end 172 of core bit 124 may include a plurality of blades 150*a*-150*g* with respective junk slots or fluid flow paths 173 disposed therebetween. Additionally, drilling fluid may exit from one or more ports and/or nozzles 176.

During a coring operation, cutting elements 158 on core bit 124 will exert forces on a core sample (e.g., core sample 144 shown in FIG. 1) or portions of a formation from which the core sample may be cut. The forces may cause damage to the core, such as wear, weakening, breakage, and/or fracturing, and may modify its characteristics compared to the in situ characteristics of the formation. A damaged core may not be as useful for analysis as it may not be representative of the original formation. Additionally, when the core breaks and/or fractures, jamming may occur where the friction between multiple pieces of the core prevents any further core from entering a coring inner barrel tube (e.g., inner barrel tube 140 shown in FIG. 1). When jamming occurs, the coring operation may have to be stopped and the core may have to be removed before the coring operation may resume. A jamming occurrence may reduce the efficiency and increase the costs of the coring operation. Additionally, a worn, broken, or fractured core may create a core sample that may be unusable or may not accurately represent the properties of the formation and/or reservoir (e.g., formation 106) and may reduce the accuracy of analysis performed on the core sample.

Core bit 124 may be designed in accordance with the present disclosure such that the forces created by cutting elements 158 that act on the core may be reduced. When core bit 124 is designed to reduce the forces acting on the core, the likelihood that the core may be damaged or the likelihood that a jamming occurrence may occur may be reduced. Core bit 124 may be modified to reduce the forces acting on the core by modifying various aspects of the cutting structure of core bit 124, such as modifying the cutting element size, cutting structure profile, mixing cutting element sizes across the cutting elements on a blade or from one blade to another blade, cutting element orientation (e.g., back rake angle and/or side rake angle), cutting element chamfer, mixing of cutting element chamfers across the cutting elements on a blade, cutting element geometry, blade count, cutting element alignment or non-alignment along the profile, and cutting element alignment or non-alignment from one blade to another blade (e.g., track-setting).

Figure 3A:
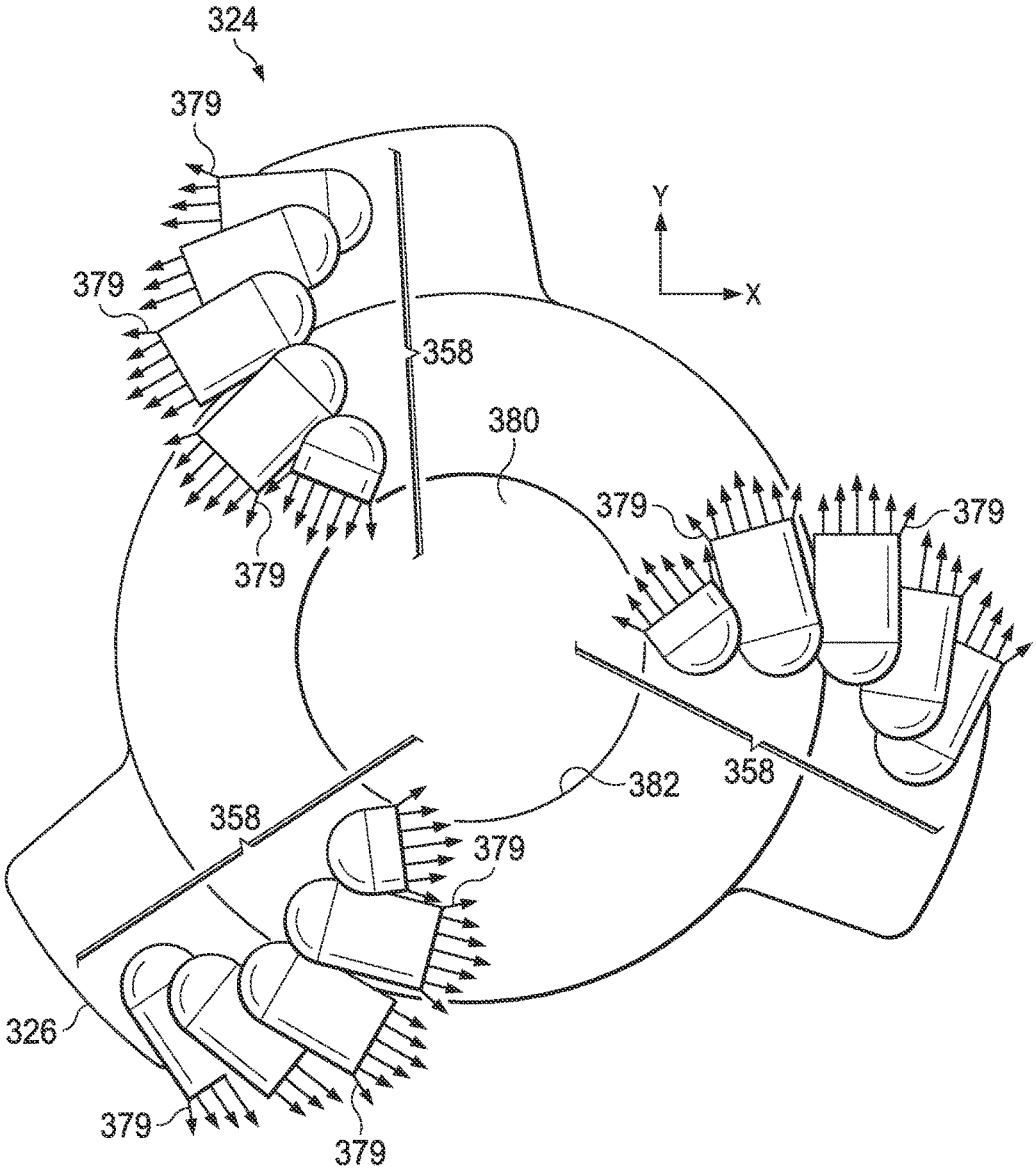
FIG. 3A illustrates a top view of a core bit including a plurality of cutting elements and force vector distributions created by each cutting element during a coring operation, shown in a plane perpendicular to the core bit axis.

FIG. 3A illustrates a top view of a core bit including a plurality of cutting elements and a force vector distribution created by each cutting element during a coring operation, shown in a plane perpendicular to the core bit axis. Cutting force vector distributions 379 may each include multiple drag force vectors or any other forces that may be created by the cutting elements. During a coring operation, some of cutting force vectors included in each force vector distribution 379 may be directed toward the core, such as a core occupying center area 380 of core bit 324.

Figure 3B:
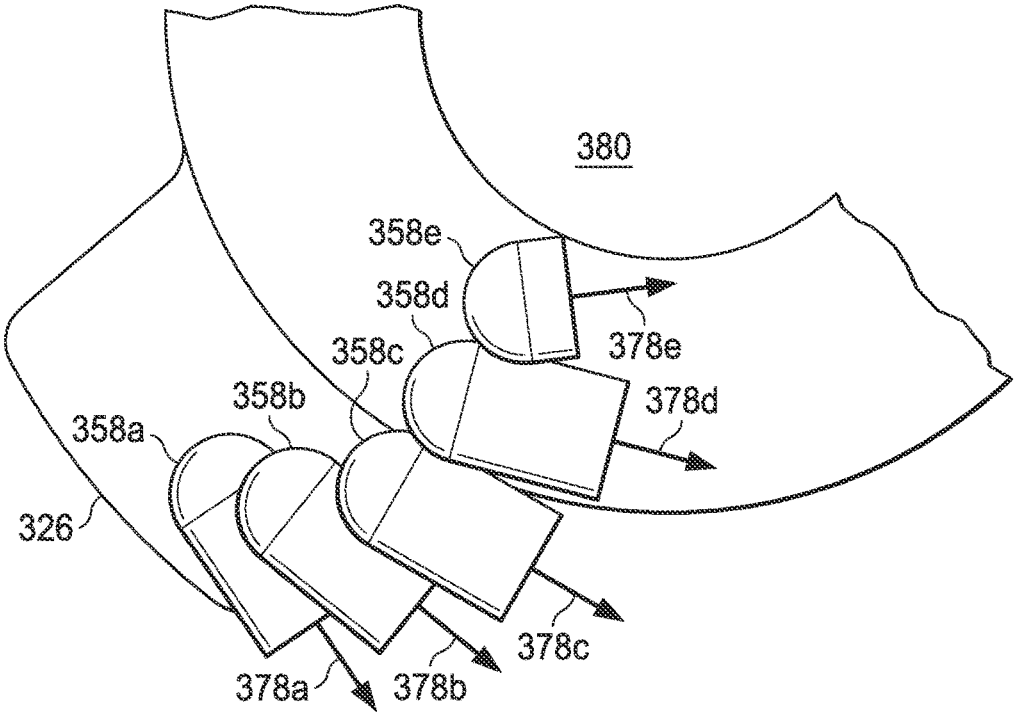
FIG. 3B illustrates a top view of one blade of a core bit including a plurality of cutting elements and the cutting force resulting vectors created by each cutting element during a coring operation, shown in a plane perpendicular to the core bit axis.

Force vector distributions 379 generated by cutting elements 358 may be used to compute the forces acting on the core sample. Force vector distribution 379 for each cutting element 358 may be summed to determine resulting cutting force vectors, created by each cutting element, acting on the core. FIG. 3B illustrates a top view of one blade of a core bit including a plurality of cutting elements and the resulting cutting force vectors created by each cutting element during a coring operation, shown in a plane perpendicular to the core bit axis. Cutting force distributions 379, shown in FIG. 3A, acting on each cutting element 358*a*-358*e* ("cutting elements 358"), may be summed to determine a resulting cutting force vector 378*a*-378*e* ("resulting cutting force vectors 378") for each cutting element 358. Resulting cutting force vector 378 may represent the sum of the direction and magnitude of the various forces generated by cutting element 358. When a force from force vector distributions 379 and/or resulting cutting force vectors 378 is directed towards the core and center area 380 of core bit 324, the force from force vector distributions 379 and/or resulting cutting force vectors 378 may cause wear or damage to a core in center area 380. Therefore, core bit 324 may be designed to reduce the magnitude of force vector distributions 379 and/or resulting cutting force vectors 378 directed toward center area 380 and/or change the direction of force vector distributions 379 and/or resulting cutting force vectors 378 such that force vector distributions 379 and/or resulting cutting force vectors 378 may be directed away from center area 380 and thus reduce the likelihood of wear, fracturing, or breakage of the core.

The design of core bit 324 may include defining one or more requirements of the coring operation, such as the diameter of the core sample, the characteristics of the geological formation, or the coring speed of the operation. For example, a hard formation may be capable of withstanding more force than a softer formation. Therefore in embodiments where the formation is soft, acceptable force vector distributions 379 and/or resulting cutting force vectors 378 directed towards center area 380 may be smaller than acceptable force vector distributions 379 and/or resulting cutting force vectors 378 in embodiments where the formation is hard. Additionally, a geological formation may be brittle or may already have existing in situ fractures and thus more susceptible to breakage during a coring operation and acceptable force vector distributions 379 and/or resulting cutting force vectors 378 may be even further reduced for brittle or fractured formations.

Once the requirements of the coring operation are defined, an initial design of core bit 324 may be generated. The initial design of core bit 324 may be based on a baseline design for a core bit or based on a core bit that may meet the requirements of the coring operation. The initial design of core bit 324 may not include consideration of force vector distributions 379 and/or resulting cutting force vectors 378 generated or how force vector distributions 379 and/or resulting cutting force vectors 378 interact with the core.

The initial design of core bit 324 may be used to calculate the forces generated by cutting elements 358. In some embodiments, the forces may be calculated for the individual cutting elements 358. In other embodiments, the forces may be calculated for cutting elements 358 on a blade by blade basis or for all of cutting elements 358 on core bit 324 as a whole. The calculated forces may include drag forces that may be used to determine the torque on bit (TOB) and lateral forces that may be used to determine a resultant radial force on bit.

In some embodiments, force vector distributions 379 and/or resulting cutting force vectors 378 generated by cutting elements 358 may be variable across blade 326. For example, cutting force vectors 378*a*-378*b* generated by cutting elements 358*a*-358*b* may be higher than cutting force vector 378*e* generated by cutting element 358*e* where cutting element 358*e* is closer to center area 380 than cutting elements 358*a* and 358*b*. Cutting force vectors 378*a* and 378*b* may be higher than cutting force vector 378*e* due to cutting elements 358*a* and 358*b* being positioned to more aggressively cut into the formation than cutting element 358*e*.

Frictional forces between core bit 324 and the core sample may also be computed. For example, as core bit 324 rotates, the core sample may be stationary. Inner diameter 382 of core bit 324 may create frictional forces on the perimeter of the core sample that may cause wear and/or overheating on the core sample. Therefore force vector distributions 379 and/or resulting cutting force vectors 378 and frictional forces may be used to determine the forces potentially acting on the core sample.

Based on the forces potentially acting on the core using the initial design, core bit 324 may be redesigned to minimize the forces, reducing the magnitude of the cutting force vector and/or reorienting the cutting force vectors outward, away from the core. In some embodiments, cutting elements 358 and portions of core bit 324 located at any point on core bit 324 may be modified. In other embodiments, the modification may focus primarily on cutting elements 358 and portions of core bit 324 nearest to the circumference of center area 380. For example, core bit 324 may have a diameter of approximately eight inches and an inner diameter of center 380 may be approximately four inches. The design process may focus on the inner portion of the core bit, such as the approximately one-half inch nearest to the circumference of center 380. Cutting elements 358 and the portion of core bit 324 nearest to the circumference of center 380 may generate the greatest cutting force vectors 378 that may act on the core and thus the redesign process may focus on these portions of core bit 324.

Figure 4A:
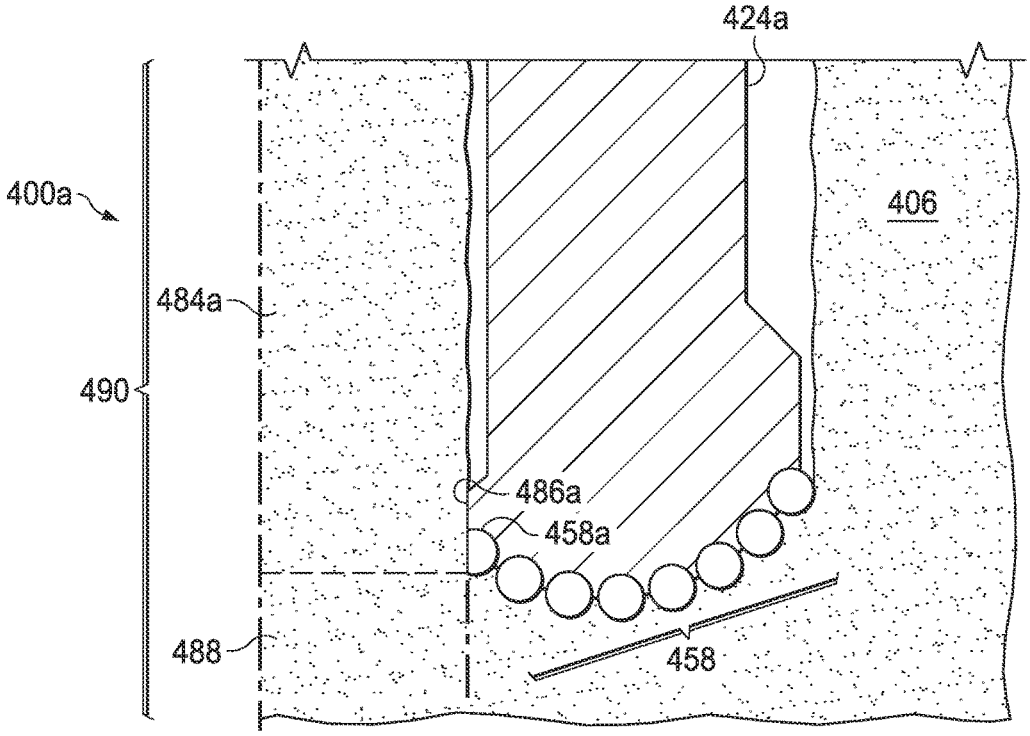
FIGS. 4A and 4B illustrate cross-sectional views of core bits sectioned through one blade, rock formations, and core samples obtained by each of the core bits.
Figure 4B:
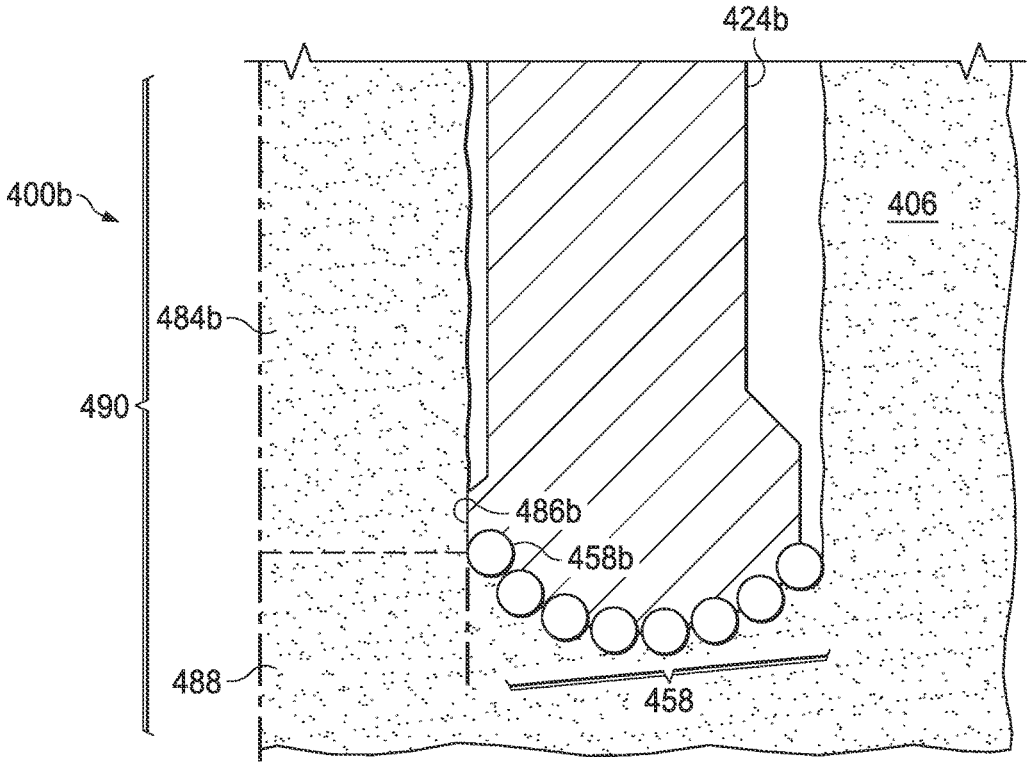

The redesign of core bit 324 may include modifying attributes of core bit 324 and/or cutting elements 358, such as the cutting element size, cutting structure profile, mixing cutting element sizes across the cutting elements on a blade, cutting element orientation (e.g., back rake angle and/or side rake angle), cutting element chamfer, mixing of cutting element chamfers across the cutting elements on a blade, and cutting element geometry (e.g., round or pre-cut as discussed in further detail with respect to FIGS. 4A and 4B). For example, a higher back rake angle may cut the geological formation less aggressively. Thus the forces generated by a cutting element with a higher back rake angle may be lower than the forces generated by a cutting element with a lower back rake angle. Therefore, in some embodiments, to reduce the magnitude of forces acting on a core, the back rake angle of cutting elements near the inner diameter of the core bit may be increased.

Once the design of core bit 324 is modified, the forces generated by cutting elements 358 and the forces acting on the core may be recalculated. The forces acting on the core may be compared to a threshold value and, if the forces are below the threshold value, the design of core bit 324 may be complete. If the forces acting on the core are above the threshold value, core bit 324 may be further modified to reduce the forces. The threshold value corresponding to the amount of force a core can withstand without wearing and/or fracturing may be based on the properties of the geological formation such as the rock formation strength, brittleness, fracturation level, and/or fracture orientation.

FIGS. 4A and 4B illustrate cross-sectional views of core bits sectioned through one blade, rock formations, and core samples obtained by each of the core bits. FIG. 4A illustrates an example core bit 424*a*. Cutting elements 458 may be exerting forces on core sample 484*a* and future core 488 (collectively referred to as "core 490"). Future core 488 may be a portion of rock formation 406 from which core sample 484*a* will be cut. Cutting element 458*a* may be a pre-cut cutting element, where cutting element 458*a* may have a flat surface where cutting element 458*a* contacts core 490. Inner gauge pad 486*a* may also be in contact with core 490. Both cutting element 458*a* and/or inner gauge pad 486*a* may create cutting forces and/or frictional forces that may act on core 490. In some embodiments, to reduce the frictional forces, the geometry of cutting element 458 nearest to core 490 (e.g., cutting element 458*a*) may be modified to minimize the amount of surface area of cutting element 458 that is in contact with core 490. For example, the cord length of cutting element 458*a* that is in contact with core 490 may be optimized to minimize the forces acting on core 490. The optimization may take into account the characteristics of rock formation 406 (e.g., hardness, brittleness, and/or fracturation level). Additionally, the characteristics of cutting element 458*a* may be modified to reduce the forces acting on core 490, such as the chamfer and/or radius size of cutting element 458*a*.

Illustrating one example of the results of optimizing cutting element 458*a*, in FIG. 4B, cutting element 458*a* in contact with core 490 is replaced by cutting element 458*b* which may have a generally circular shape. The portion of the perimeter of cutting element 458*b* in contact with core 490 may be smaller than the portion of the perimeter of cutting element 458*a* in contact with core 490. Thus the frictional forces exerted on core 490 by cutting element 458*b* may be smaller than the frictional forces exerted on core 490 by cutting element 458*a*.

Figure 5A:
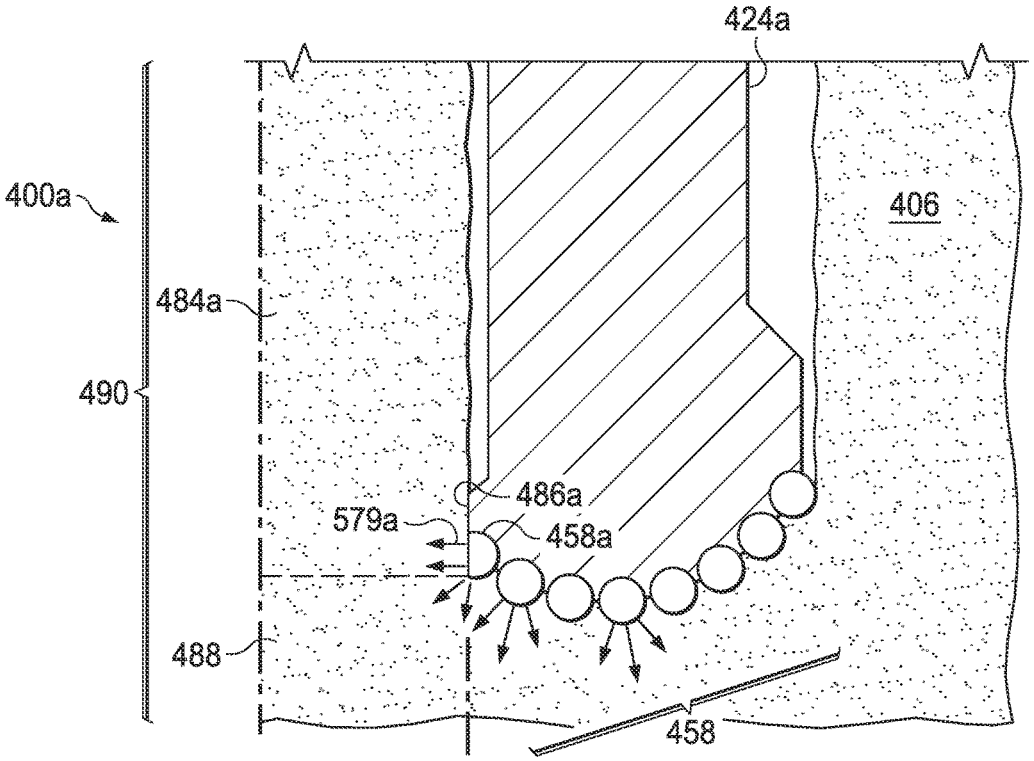
FIGS. 5A and 5B illustrate cross-sectional views of core bits sectioned through one blade, rock formations, core samples obtained by each of the core bits, and a force vector distribution per cutting element in a plane passing through the core bit axis.
Figure 5B:
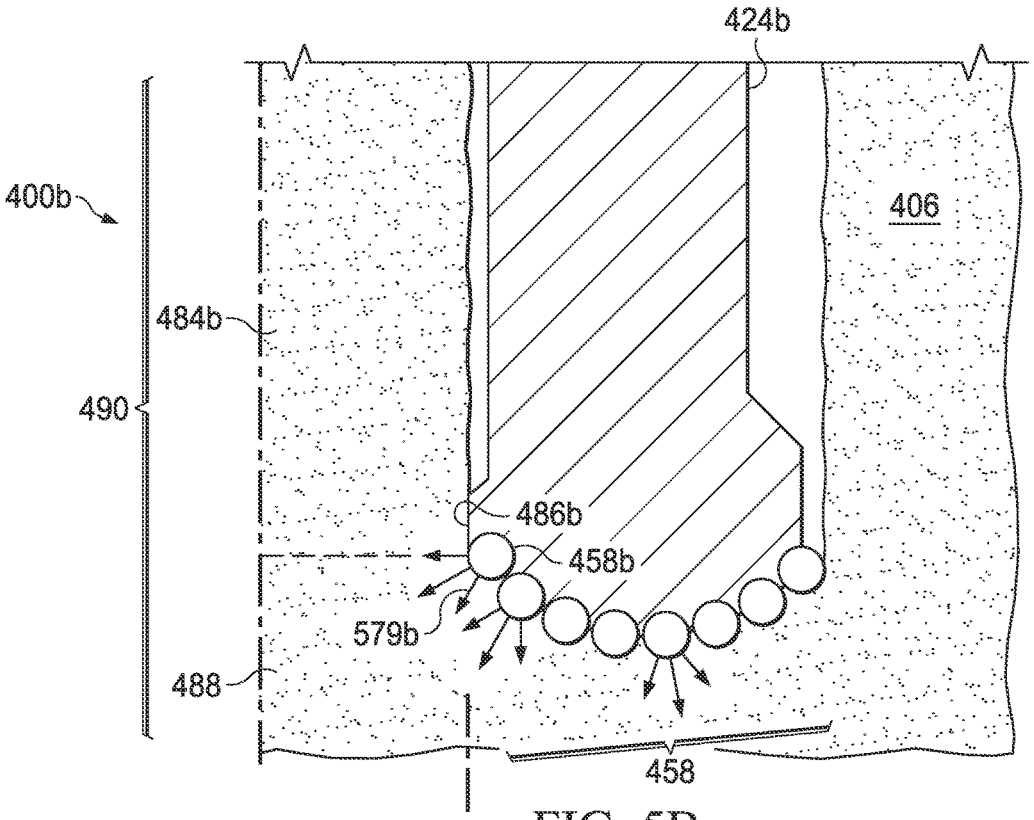

FIGS. 5A and 5B illustrate cross-sectional views of core bits sectioned through one blade, rock formations, core samples obtained by each of the core bits, and force vector distributions per cutting element in a plane passing through the core bit axis. FIGS. 5A and 5B illustrate the effects of changing cutting element 458*a* to cutting element 458*b*. Force vector distribution 579*a* for cutting element 458*a* shows part of the force vectors directed towards core 490. After cutting element 458*a* is replaced by cutting element 458*b* in FIG. 5B, force vector distribution 579*b* illustrates that the number and/or magnitude of force vectors directed towards core 490 may be reduced.

Figure 6A:
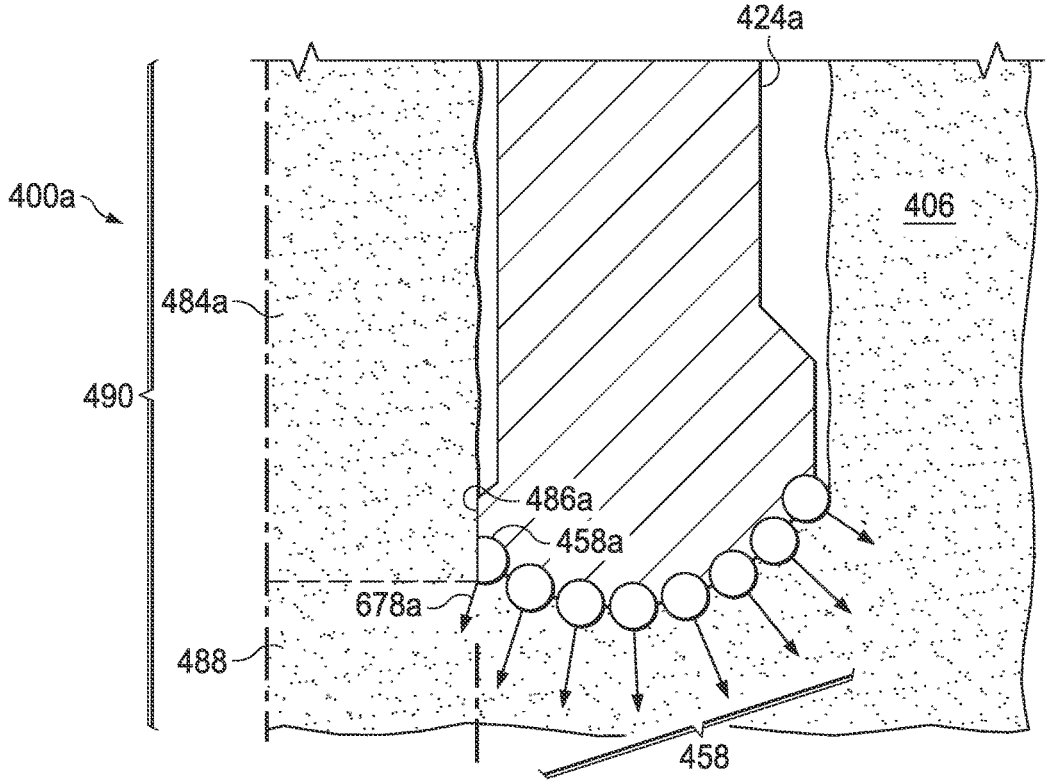
FIGS. 6A and 6B illustrate cross-sectional views of core bits sectioned through one blade, rock formations, core samples obtained by each of the core bits, and force resulting vectors per cutting element in a plane passing through the core bit axis.
Figure 6B:
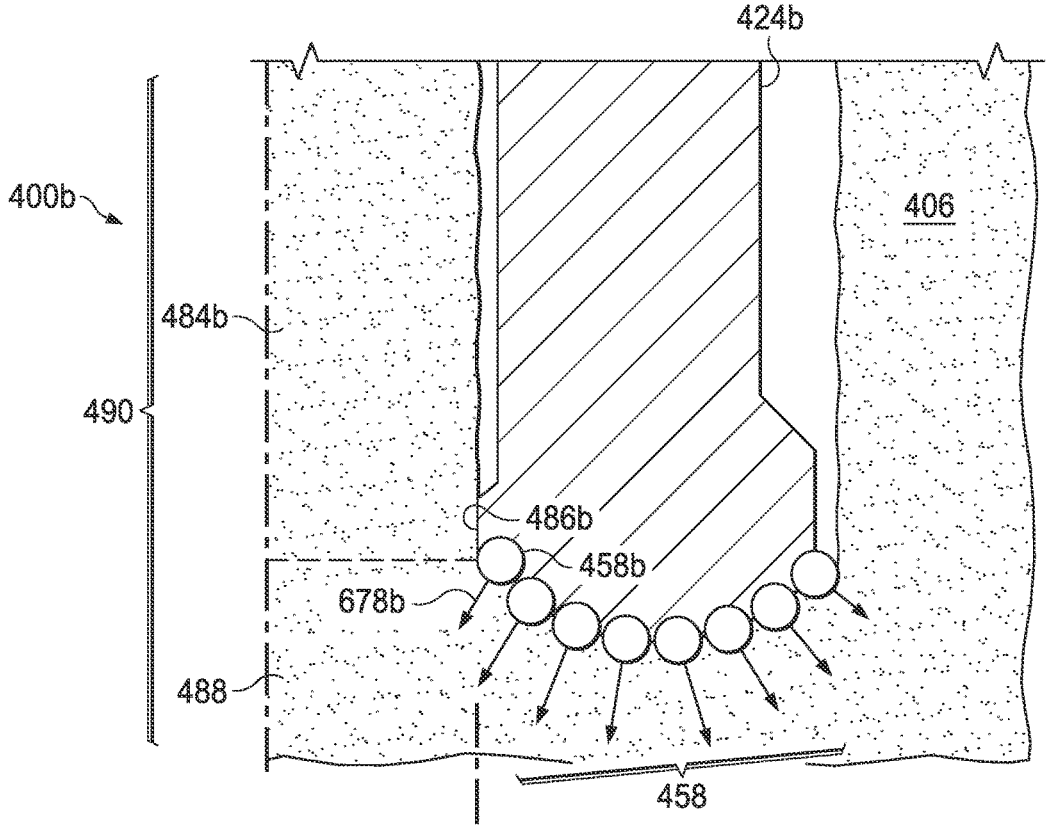

FIGS. 6A and 6B illustrate cross-sectional views of core bits sectioned through one blade, rock formations, core samples obtained by each of the core bits, and resulting force vectors per cutting element in a plane passing through the core bit axis. FIGS. 6A and 6B illustrate the effects of changing cutting element 458*a* to cutting element 458*b* based on the resulting force vector per cutter 578*a* and 578*b* generated by cutting elements 458*a* and 458*b*, respectively, based on the force vector distributions shown in FIGS. 5 and 5B. Force vector distributions 579*a* and 579*b* may be summed to create a resulting force vector 678*a* and 678*b*, respectively. After cutting element 458*a* is replaced by cutting element 458*b* in FIG. 6B, resulting force vector 678*b* illustrates that the magnitude and/or direction of resulting force vector 678*b* directed towards core 490 is reduced when compared to resulting force vector 678*a* shown in FIG. 6A.

Figure 7:
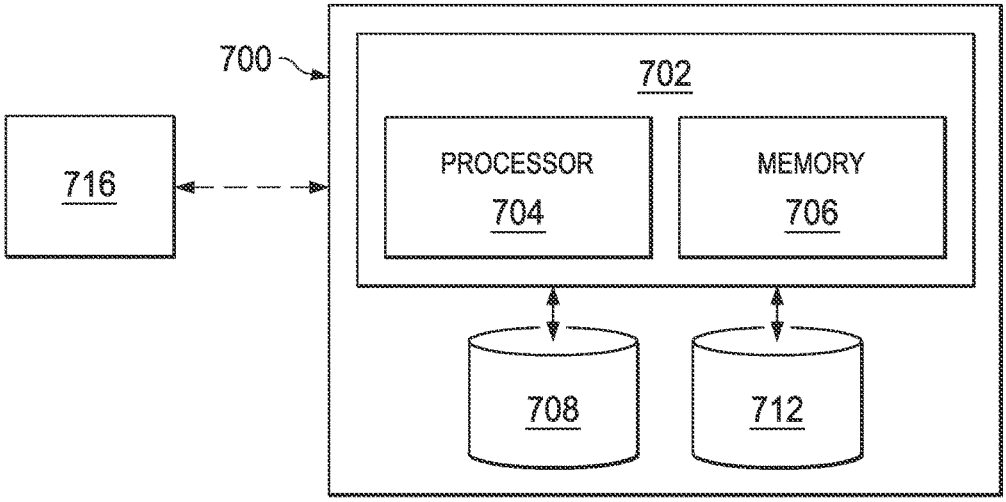
FIG. 7 illustrates a block diagram of an exemplary core bit modeling system.

FIG. 7 illustrates a block diagram of an exemplary core bit modeling system. Modeling system 700 may be configured to model the forces generated by the cutting elements of a core bit and the effect of the forces on a core sample, such as core bit 124 and core sample 144 shown in FIGS. 1 and 2. In some embodiments, modeling system 700 may include modeling module 702. Modeling module 702 may be used to perform the steps of method 800 as described with respect to FIG. 8. Modeling module 702 may include any suitable components. For example, in some embodiments, modeling module 702 may include processor 704. Processor 704 may include, for example a microprocessor, microcontroller, digital signal processor (DSP), application specific integrated circuit (ASIC), or any other digital or analog circuitry configured to interpret and/or execute program instructions and/or process data. In some embodiments, processor 704 may be communicatively coupled to memory 706. Processor 704 may be configured to interpret and/or execute program instructions and/or data stored in memory 706. Program instructions or data may constitute portions of software for carrying out the design of a core bit that exerts minimal forces or forces below a given threshold on a core sample, as described herein. Memory 706 may include any system, device, or apparatus configured to hold and/or house one or more memory modules; for example, memory 706 may include read-only memory, random access memory, solid state memory, or disk-based memory. Each memory module may include any system, device or apparatus configured to retain program instructions and/or data for a period of time (e.g., computer-readable non-transitory media).

Modeling system 700 may further include geological formation database 708. Geological formation database 708 may be communicatively coupled to modeling module 702 and may provide values that may be used to design a core bit in response to a query or call by modeling module 702. Geological formation database 708 may be implemented in any suitable manner, such as by functions, instructions, logic, or code, and may be stored in, for example, a relational database, file, application programming interface, library, shared library, record, data structure, service, software-as-service, or any other suitable mechanism. Geological formation database 708 may include code for controlling its operation such as functions, instructions, or logic. Geological formation database 708 may specify any suitable parameters that may be used to design a core bit, such as the hardness or brittleness of the formation, the number of fractures existing in the formation, and/or the orientation of any fractures in the formation.

Modeling system 700 may further include cutting element database 712. Cutting element database 712 may be communicatively coupled to modeling module 702 and may provide parameters for designing a cutting element in response to a query or call by modeling module 702. Cutting element database 712 may be implemented in any suitable manner, such as by functions, instructions, logic, or code, and may be stored in, for example, a relational database, file, application programming interface, library, shared library, record, data structure, service, software-as-service, or any other suitable mechanism. Cutting element database 712 may include code for controlling its operation such as functions, instructions, or logic. Cutting element database 712 may specify any suitable properties of a cutting element that may be used on a core bit, such as the size, orientation, chamfer, angle, and/or geometry or shape of the cutting element. Although modeling system 700 is illustrated as including two databases, modeling system 700 may contain any suitable number of databases.

In some embodiments, modeling module 702 may be configured to design a core bit that minimizes the forces on a core sample. For example, modeling module 702 may be configured to import one or more instances of geological formation database 708, and/or one or more instances of cutting element database 712. Values from geological formation database 708, and/or cutting element database 712 may be stored in memory 706. Modeling module 702 may be further configured to cause processor 704 to execute program instructions operable to generate a design for a core bit and minimize the forces exerted on a core sample by the cutting elements on the core bit. For example, processor 704 may, based on values in geological formation database 708 and cutting element database 712, calculate the forces generated by the cutting elements on a core bit, calculate the force on a core sample, and modify the design of the core bit to minimize the forces acting on the core sample, as discussed in further detail with reference to FIG. 8.

Modeling system 700 may be communicatively coupled to one or more displays 716 such that information processed by modeling module 702 (e.g., designs for the core bit) may be conveyed or displayed to designers of a core bit.

Modifications, additions, or omissions may be made to FIG. 7 without departing from the scope of the present disclosure. For example, FIG. 7 shows a particular configuration of components for modeling system 700. However, any suitable configurations of components may be used. For example, components of modeling system 700 may be implemented either as physical or logical components. Furthermore, in some embodiments, functionality associated with components of modeling system 700 may be implemented in special purpose circuits or components. In other embodiments, functionality associated with components of modeling system 700 may be implemented in a general purpose circuit or components of a general purpose circuit. For example, components of modeling system 700 may be implemented by computer program instructions.

Figure 8:
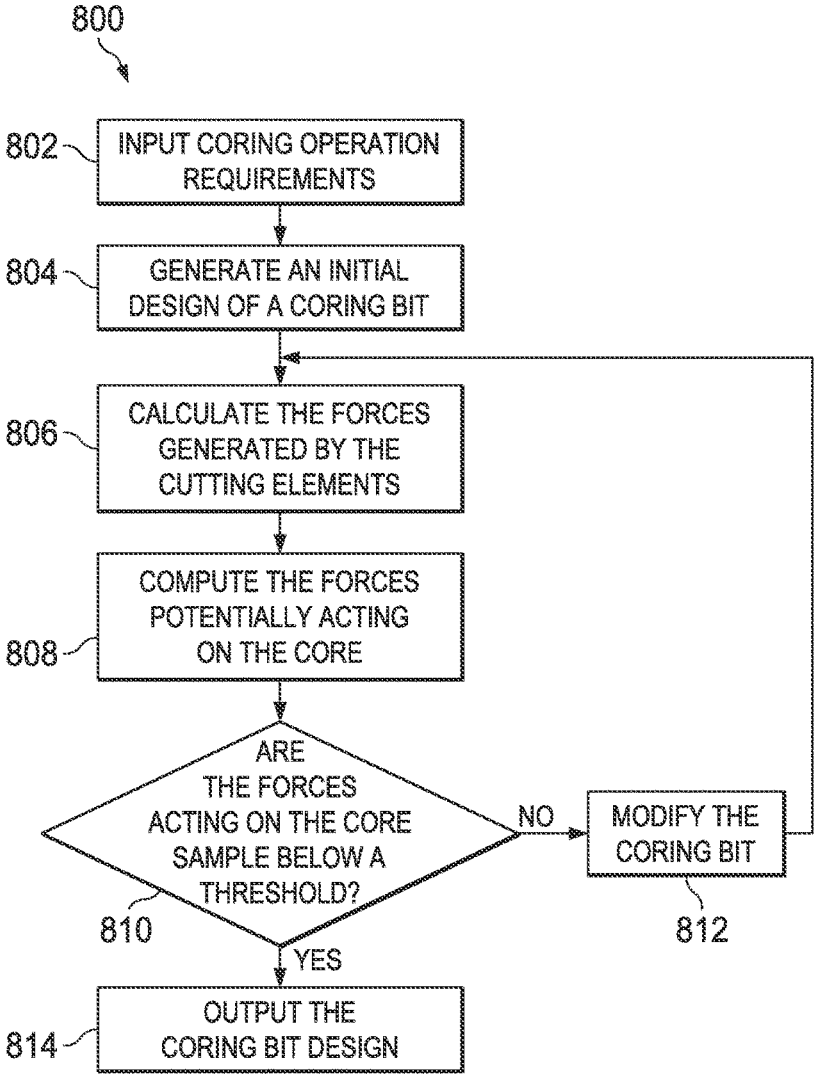
FIG. 8 illustrates a flow chart of a method for designing a core bit to reduce the forces acting on a core.

FIG. 8 illustrates a flow chart of a method for designing a core bit to reduce or minimize the forces acting on a core. The steps of method 800 may be performed by various computer programs, models, or any combination thereof, configured to simulate and design drilling systems, apparatuses and devices, such as the modeling system illustrated in FIG. 7. For illustrative purposes, method 800 is described with respect to the coring systems as illustrated in the previous FIGURES; however, method 800 may be used to design a core bit for any subterranean operation.

Method 800 may begin at step 802 where the modeling system may input one or more requirements of a coring operation. In some embodiments, the requirements of the coring operation may be based on the requirements of the analysis performed on the core sample, such as the size of the core sample and/or the amount of fractures in the core sample that may be acceptable without impacting the accuracy of the analysis. In other embodiments, the requirements of the coring operation may be based on attributes of a target reservoir, such as the depth of the reservoir and/or the operating time to reach the reservoir. In further embodiments, the requirements of the coring operation may be based on properties of the geological formation, such as the hardness, brittleness, presence of fractures in the formation, and/or orientation of the fractures in the formation.

In step 804, the modeling system may generate an initial design of a core bit. In some embodiments, the initial design may be based on a baseline design for a core bit. In other embodiments, the initial design may be based on at least one of the requirements of the coring operation, as input in step 802. For example, the core recovery difficulty may be used to determine an acceptable forces threshold. The initial design of the core bit may or may not take into consideration the forces generated by the cutting elements of the core bit and the way the forces act on a core.

In step 806, the modeling system may calculate the forces acting on the core generated by the cutting elements of the core bit designed in step 804. The calculated forces may include drag forces, (e.g., TOB) and/or radial forces. The forces may be calculated on a cutting element by cutting element basis, along the contact surface with the rock formation, to determine the forces generated by individual cutting elements and how the forces vary across a blade of the core bit. For example, the forces generated by cutting elements located further from the center of the core bit may be higher than the forces generated by cutting elements located closer to the core. In some embodiments, the modeling system may calculate the overall resulting forces for the core bit as a whole.

In step 808, the modeling system may calculate the forces acting on a core. The forces acting on the core (e.g., the core sample and/or the portions of the formation that will be cut to form a core sample) may be the forces generated by the cutting elements of the core bit, as calculated in step 806, or may be frictional forces caused by the friction between the rotating inner diameter of the core bit and the stationary core. The forces generated by the cutting elements may be summed to determine a total cutting force vector acting on the core. The modeling system may calculate an effective force per cutting element acting on the core, taking into account the length and orientation of the force vector, the characteristics of the rock formation, and the distance between the cutting element force application point to the core.

The modeling system may display the forces generated by the cutting elements graphically to assist in determining a modification to make to the core bit design. For example, the modeling system may display the cutting force vectors of the cutting elements across a blade of the core bit to illustrate the variation of forces across the blade and indicate which cutting elements have the greatest cutting force vectors directed towards the core. The graphical visualization may also display a distribution of torque per cutting element, resulting force vectors acting on the core, moments exerted on the core, and/or any other suitable data point.

In step 810, the modeling system may determine whether the forces acting on the core are below a threshold value. The threshold value criteria may be based on the properties of the geological formation, such as the hardness of the formation, and may indicate the amount of force the core may be capable of withstanding without fracturing, breaking, and/or wearing. If the forces acting on the core are below the threshold value, the core bit may be sufficiently designed to minimize the forces acting on the core and method 800 may proceed to step 814 to finalize the core bit design. However, if the forces acting on the core are above the threshold value, method 800 may proceed to step 812.

In step 812, the modeling system may modify the design of the core bit. The modifications made to the core bit may reduce the forces acting on the core. For example, the modeling system may modify any attribute of the core bit that may reduce the forces acting on the core, such as the cutting element size, the cutting structure profile, mixing cutting element sizes across the core bit, the cutting element orientation (e.g., back rake angle and/or side rake angle), the cutting element chamfer or radius, mixing of cutting element chamfers across the core bit, and/or the cutting element geometry (e.g., round or pre-cut). The modeling system may modify any number of cutting elements and/or portions of the core bit. For example, the modeling system may modify the cutting elements near the inner diameter of the core bit and/or may modify any cutting elements along the cutting structure profile of the core bit.

The modification may also include balancing the cutting forces across the core bit face and/or balancing the cutting forces on cutting elements in contact with the core. In embodiments where the forces are balanced, some cutting elements may exert a force vector on the core and other cutting elements may exert a force vector in an equal and opposite direction such that the total resulting cutting force exerted on the core is minimal.

Once the core bit design has been modified in step 812, method 800 may return to step 802 to calculate the forces on the core generated by the cutting elements of the modified core bit. Method 800 may then compute the forces acting on the core by the modified core bit and determine if the forces are below the threshold value. Method 800 may iteratively modify the design of the core bit until the forces acting on the core are below the threshold value.

In step 814, the modeling system may output the design of the core bit. The core bit design output may be used to manufacture a core bit having the characteristics of the design of the core bit and/or may be used to produce additional visualizations of the forces generated by the core bit and the interaction of the forces with the core.

Modifications, additions, or omissions may be made to method 800 without departing from the scope of the present disclosure. For example, the order of the steps may be performed in a different manner than that described and some steps may be performed at the same time. Additionally, each individual step may include additional steps without departing from the scope of the present disclosure.

Embodiments Disclosed Herein Include

A. A method for designing a core bit including generating a model of a core bit including a plurality of cutting elements on a plurality of blades, simulating a coring operation with the model of the core bit, calculating at least one force vector generated by at least one of the plurality of cutting elements on the model of the core bit during the coring operation, determining at least one force acting on a core in the model of the core bit based on the at least one force vector, and generating a design of the core bit based on the at least one force acting on the core.

B. A non-transitory machine-readable medium including instructions stored therein, the instructions executable by one or more processors to facilitate performing a method for reducing the forces acting on a core including generating a model of a core bit including a plurality of cutting elements on a plurality of blades, simulating a coring operation with the model of the core bit, calculating at least one force vector generated by at least one of the plurality of cutting elements on the model of the core bit during the coring operation, determining at least one force acting on a core in the model of the core bit based on the at least one force vector, and generating a design of the core bit based on the at least one force acting on the core.

C. A coring system including a drill string and a coring bit coupled to the drill string. The coring bit including a bit body including a plurality of blades, a plurality of cutting elements on one of the plurality of blades, and a receptacle in a center of the coring bit to receive a core. The interaction of the coring bit on the core is estimated by: generating a model of a core bit including a plurality of cutting elements on a plurality of blades, simulating a coring operation with the model of the core bit, calculating at least one force vector generated by at least one of the plurality of cutting elements on the model of the core bit during the coring operation, determining at least one force acting on a core in the model of the core bit based on the at least one force vector, and generating a design of the core bit based on the at least one force acting on the core.

Each of embodiments A, B, and C may have one or more of the following additional elements in any combination: Element 1: further comprising calculating at least one second force vector generated by at least one inner gauge pad in contact with the core during the coring operation. Element 2: further including displaying at least one of the force vectors generated by at least one of the plurality of cutting elements and the force acting on the core. Element 3: wherein the force acting on the core includes a frictional force. Element 4: wherein generating the design of the core bit comprises modifying at least one of a cutting structure profile, a size, an orientation, a chamfer, a radius, and a geometry of at least one of the plurality of cutting elements. Element 5: wherein generating the design of the core bit comprises modifying a design of the core bit if the at least one force is above a predetermined threshold in order to reduce the force acting on the core during the coring operation. Element 6: wherein the predetermined threshold is based on a property of a geological formation. Element 7: wherein generating the design of the core bit includes considering a requirement of a coring operation.

Although the present disclosure and its advantages have been described in detail, it should be understood that various changes, substitutions and alterations can be made herein without departing from the spirit and scope of the disclosure as defined by the following claims.

What is claimed is:

1. A method for designing a core bit, comprising:

generating a model of a core bit including a plurality of cutting elements on a plurality of blades;

simulating a coring operation with the model of the core bit;

calculating a first one force vector generated by a first of the plurality of cutting elements in contact with a core sample during the coring operation;

calculating a second force vector generated by a second of the plurality of cutting elements in contact with the core sample during the coring operation;

determining a resulting cutting force acting on the core sample in the model of the core bit based on the first and second force vectors;

determining whether the resulting cutting force is below a threshold value, the threshold value based on an expected property of the core sample; and based on the determination, generating a design of the core bit to balance the resulting cutting force on the core sample and reduce the resulting cutting force below the threshold value.

2. The method of claim 1, further comprising calculating at least one second force vector generated by at least one inner gauge pad in contact with the core sample during the coring operation.

3. The method of claim 1, further comprising displaying at least one of the force vectors generated by at least one of the plurality of cutting elements and the force acting on the core sample.

4. The method of claim 1, wherein the force acting on the core sample includes a frictional force.

5. The method of claim 1, wherein generating the design of the core bit comprises modifying at least one of a cutting structure profile, a size, an orientation, a chamfer, a radius, and a geometry of at least one of the plurality of cutting elements.

6. The method of claim 1, wherein generating the design of the core bit comprises considering a requirement of a coring operation.

7. A non-transitory machine-readable medium comprising instructions stored therein, the instructions executable by one or more processors to facilitate performing a method for reducing the forces acting on a core, comprising:

generating a model of a core bit including a plurality of cutting elements on a plurality of blades;

simulating a coring operation with the model of the core bit;

calculating a first one force vector generated by a first of the plurality of cutting elements in contact with a core sample during the coring operation;

calculating a second force vector generated by a second of the plurality of cutting elements in contact with the core sample during the coring operation;

determining a resulting cutting force acting on the core sample in the model of the core bit based on the first and second force vectors;

determining whether the resulting cutting force is below a threshold value, the threshold value based on an expected property of the core sample; and based on the determination, generating a design of the core bit to balance the resulting cutting force on the core sample and reduce the resulting cutting force below the threshold value.

8. The non-transitory machine-readable medium of claim 7, method further comprising calculating at least one second force vector generated by at least one inner gauge pad in contact with the core sample during the coring operation.

9. The non-transitory machine-readable medium of claim 7, the method further comprising displaying at least one of the force vectors generated by at least one of the plurality of cutting elements and the force acting on the core sample.

10. The non-transitory machine-readable medium of claim 7, wherein the force acting on the core sample comprises a frictional force.

11. The non-transitory machine-readable medium of claim 7, wherein generating the design of the core bit comprises modifying at least one of a cutting structure profile, a size, an orientation, a chamfer, a radius, and a geometry of at least one of the plurality of cutting elements.

12. A coring system comprising:

a drill string; and a coring bit coupled to the drill string, the coring bit comprising:

a bit body including a plurality of blades;

a plurality of cutting elements on one of the plurality of blades; and a receptacle in a center of the coring bit to receive a core sample;

wherein the interaction of the coring bit on the core sample is estimated by:

generating a model of a core bit including a plurality of cutting elements on a plurality of blades;

simulating a coring operation with the model of the core bit;

calculating a first one force vector generated by a first of the plurality of cutting elements in contact with the core sample during the coring operation;

calculating a second force vector generated by a second of the plurality of cutting elements in contact with the core sample during the coring operation;

determining a resulting cutting force acting on the core sample in the model of the core bit based on the first and second force vectors;

determining whether the resulting cutting force is below a threshold value, the threshold value based on an expected property of the core sample; and based on the determination, generating a design of the core bit to balance the resulting cutting force on the core sample and reduce the resulting cutting force below the threshold value.

13. The coring system of claim 12, wherein estimating the interaction of the coring bit on the core sample further includes calculating at least one second force vector generated by at least one inner gauge pad in contact with the core sample during the coring operation.

14. The coring system of claim 12, wherein the interaction of the coring bit on the core sample is further estimated by displaying at least one of the force vectors generated by at least one of the plurality of cutting elements and the force acting on the core sample.

15. The coring system of claim 12, wherein the force acting on the core sample comprises a frictional force.

16. The coring system of claim 12, wherein generating the design of the core bit comprises modifying at least one of a cutting structure profile, a size, an orientation, a chamfer, a radius, and a geometry of at least one of the plurality of cutting elements.

17. The method of claim 1, wherein the threshold value relates to a hardness of the core sample.

18. The non-transitory machine-readable medium of claim 7, wherein the threshold value relates to a hardness of the core sample.

19. The coring system of claim 12, wherein the threshold value relates to a hardness of the core sample.

* * * * *